United States Patent [19]

Kamp et al.

[11] Patent Number: 4,674,695

[45] Date of Patent: Jun. 23, 1987

[54] THREAD TRAVERSING DEVICE OF A MACHINE FOR PRODUCING CROSS-WOUND BOBBINS

[75] Inventors: Heinz Kamp, Wegberg; Rolf Becker, Moenchengladbach, both of Fed. Rep. of Germany

[73] Assignee: W. Schlafhorst & Co., Moenchengladbach, Fed. Rep. of Germany

[21] Appl. No.: 828,276

[22] Filed: Feb. 11, 1986

[30] Foreign Application Priority Data

Feb. 15, 1985 [DE] Fed. Rep. of Germany ..... 3505188

[51] Int. Cl.[4] ..... B65H 54/28

[52] U.S. Cl. ..... 242/43 A; 242/158 B

[58] Field of Search ..... 242/43 A, 43 R, 158 B

[56] References Cited

U.S. PATENT DOCUMENTS

| | | | |
|---|---|---|---|
| 1,239,669 | 9/1917 | Colman | 242/43 A |
| 2,238,128 | 4/1941 | Nydegger | 242/43 A |
| 2,662,695 | 12/1953 | Ballard | 242/43 A |
| 3,294,327 | 12/1966 | Horwood | 242/158 B X |
| 3,333,782 | 8/1967 | Beckwith, Jr. | 242/158 B X |
| 3,374,961 | 3/1968 | Otsuka et al. | 242/43 A |
| 3,489,359 | 1/1970 | Richter | 242/158 B X |
| 3,491,962 | 1/1970 | Roberts | 242/158 B X |
| 3,565,359 | 2/1971 | Goodhue | 242/158 B X |
| 3,595,494 | 7/1971 | Goodhue | 242/158 B X |
| 3,627,215 | 12/1971 | Richter | 242/158 B X |
| 4,165,047 | 8/1979 | Mackie | 242/43 A |
| 4,349,160 | 9/1982 | Niederer | 242/43 A X |

FOREIGN PATENT DOCUMENTS

| | | | |
|---|---|---|---|
| 2622243 | 12/1977 | Fed. Rep. of Germany | 242/43 A |
| 96546 | 8/1976 | Japan | 242/43 A |

*Primary Examiner*—Stanley N. Gilreath

*Attorney, Agent, or Firm*—Herbert L. Lerner; Laurence A. Greenberg

[57] ABSTRACT

A thread traversing device of a cross-wound bobbin producing machine includes a belt drive having a first belt run with a first thread follower moving in a given traversing direction at a given speed and a second belt run with a second thread follower moving in a direction opposite to the given traversing direction at the given speed, the thread followers having upper ends and being spaced apart by at most twice a given traversing width, and a stationary thread guide for transferring a running thread from one of the thread followers to the other, the thread guide having a concave thread guiding contour touched by the running thread with reversing points defining a traversing path therebetween, the thread guiding contour lifting the running thread at the reversing points over the upper end of one of the thread followers so that the thread is taken along by the other of the thread followers and rides on the thread guiding contour.

11 Claims, 13 Drawing Figures

THREAD TRAVERSING DEVICE OF A MACHINE FOR PRODUCING CROSS-WOUND BOBBINS

The invention relates to a thread traversing device of a machine for producing cross-wound bobbins, including a chain or belt drive with a first belt run moving in a traversing direction and a second belt run moving at the same velocity in the opposite direction, each belt run being provided with a thread follower mutually spaced apart by at most twice the traversing width, and thread guiding means for transferring the thread at reversing points of a traversing path from the thread follower of one belt run to the thread follower of the other belt run.

The problem encountered when traversing a thread stems from requirements for keeping the thread traversing motion as uniform as possible over the entire traversed path, for moving the thread as rapidly as possible into the opposite direction at the reversing points, and thus for avoiding errors in the thread laying pattern, as far as possible.

With the conventional thread traversing devices it is not possible to produce a cross-wound bobbin with uniformly distributed thread mass. The thread is more heavily applied at the reversal points at the ends of the bobbin than at the remaining portion, so that the cross-wound bobbin assumes a hyperbolic shape during the winding operation.

Another disadvantage of conventional thread traversing devices is that only a relative low winding speed can be achieved.

It is accordingly an object of the invention to provide a thread traversing device df a machine for producing cross-wound bobbins, which overcomes the hereinafore-mentioned disadvantages of the heretofore-known devices of this general type, and to provide simple means which make it possible to produce a cross-wound bobbin with a satisfactory structure and equalized thread density and mass at a very high winding speed.

With the foregoing and other objects in view there is provided, in accordance with the invention, a thread traversing device of a cross-wound bobbin or cheese producing machine, comprising a chain or belt drive having a first belt run with a first thread follower moving in a given traversing direction at a given speed and a second belt run with a second thread follower moving in a direction opposite to the given traversing direction at the given speed, the thread followers having upper ends and being spaced apart by at most twice a given traversing width, and stationary thread guiding means for transferring a running thread from one of the thread followers to the other, the thread guiding means having a concave thread guiding contour touched by the running thread with reversing points defining a traversing path therebetween, the thread guiding contour lifting the running thread at the reversing points over the upper end of one of the thread followers so that the thread is taken along by the other of the thread followers and rides on the thread guiding contour.

The thread guiding contour forms a concave line which recedes in its middle portion toward the belt runs, so that the contour need not necessarily have the same radius of curvature over its entire length.

A device of this type can achieve a high winding speed. After the thread has slid off of one of the thread followers, it immediately starts to travel along the thread guiding contour toward the middle of the thread guide, it is reached during its travel by the other thread follower of the other belt run and it is taken along by the other thread follower. This manner of guiding the thread is very reliable. The thread follower is not likely to lose the thread and a very high winding speed can be attained.

In accordance with another feature of the invention, the thread guiding means includes thread stops at the reversing points. In this way, the thread cannot travel beyond these stops, so that even the edges of the cheese are relatively flat.

In accordance with a further feature of the invention, the thread guiding means include a projection disposed at each respective reversing point pointing toward the other reversing point and forming a wedge with the thread guiding contour defining the thread stops. In this case the thread cannot deviate upward, even at high winding speeds.

In accordance with an added feature of the invention, the thread guiding means are disposed between the belt runs travelling in opposite directions. Depending on the construction of the belt or chain drive, this could relate to the front or rear run of the same belt. However, two belts could also be provided, whereby the run of one belt running to the left runs along the run of the other belt running to the right, and the thread guide is disposed between them.

In accordance with an additional feature of the invention, the thread guiding means are in the form of a plate separating the oppositely travelling belt runs from each other. Such a plate makes it possible to place the belts very close to each other. This increases the reliability of the traversing operation.

At high velocities the running thread has a tendency to vibrate, and this can also reduce the reliability of the traversing operation.

In accordance with again another feature of the invention, the thread guiding means are disposed on one side of one of the belt runs, and including at least one other thread guiding means disposed on the opposite side of the one belt run. This is done to assure the reliability of the traversing operation even in this case. This configuration may be formed of different combinations of thread guides. The additional thread guide is either in front of the first run or behind the second run, or there is an additional thread guide in front of the first run and a second additional thread guide behind the second run.

Further developments of the invention are advantageous for achieving even greater reliability and even greater winding speeds.

In accordance with again a further feature of the invention, the wedges of the first-mentioned thread guiding means are farther apart from each other than the wedges of the other thread guiding means.

In accordance with again an added feature of the invention, the wedges of the other thread guiding means are closer to the one belt run than the wedges of the first-mentioned thread guiding means. For example, this permits a polygonal conduction of the thread through the two or three thread guides. It is also advantageous to conduct the thread in this way at high winding speeds.

In accordance with again an additional feature of the invention, the thread guiding contour of the first-mentioned thread guiding means is more concave than the thread guiding contour of the other thread guiding means. This also enhances the rapid reversal of the thread direction at the reversing points of the traversing path.

If there are not more than two thread guides provided, it is of advantage to place the second thread guide alongside the run which lies closer to the cheese.

In accordance with yet another feature of the invention, there are provided bridges disposed outside the traversing path interconnecting the first-mentioned and other thread guiding means.

In accordance with yet a further feature of the invention, the first-mentioned and other guiding means and the bridges are made of bent and formed sheet metal.

In accordance with yet an added feature of the invention, the bridges are disposed less than the width of a finger of an operator of the machine from each other and from the thread guiding contours for accident protection.

In accordance with a concomitant feature of the invention, the bobbin producing machine includes a plurality of winding stations with centers mutually spaced apart by a distance equal to twice the given traversing width, and the belts carrying the followers are disposed along more than one of the winding stations. In this case, less rotating parts are required.

Other features which are considered as characteristic for the invention are set forth in the appended claims.

Although the invention is illustrated and described herein as embodied in a thread traversing device of a machine for producing cross-wound bobbins, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
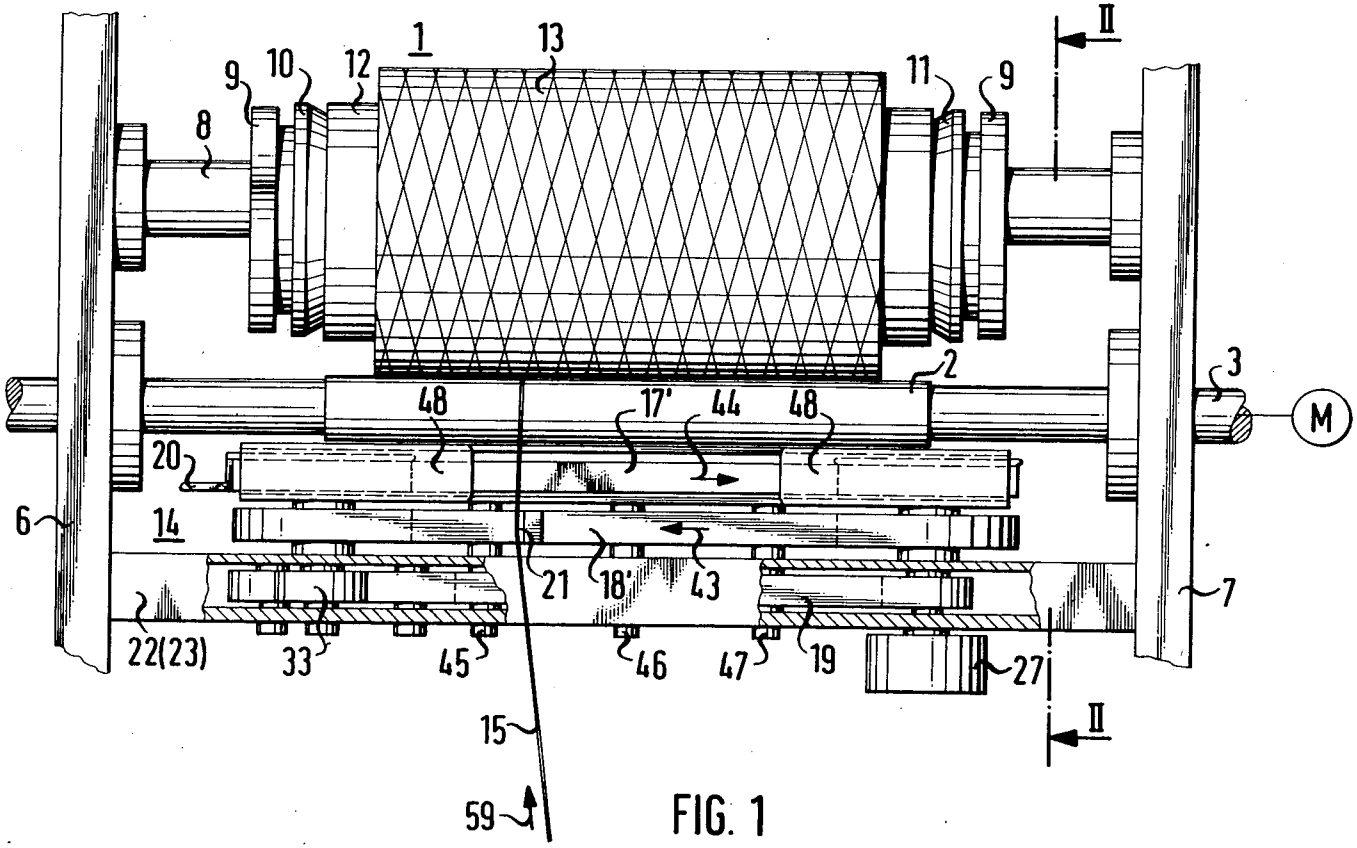
FIG. 1 is a fragmentary, diagrammatic, front-elevational view, partially broken away, of a first embodiment of the invention.
Figure 2:
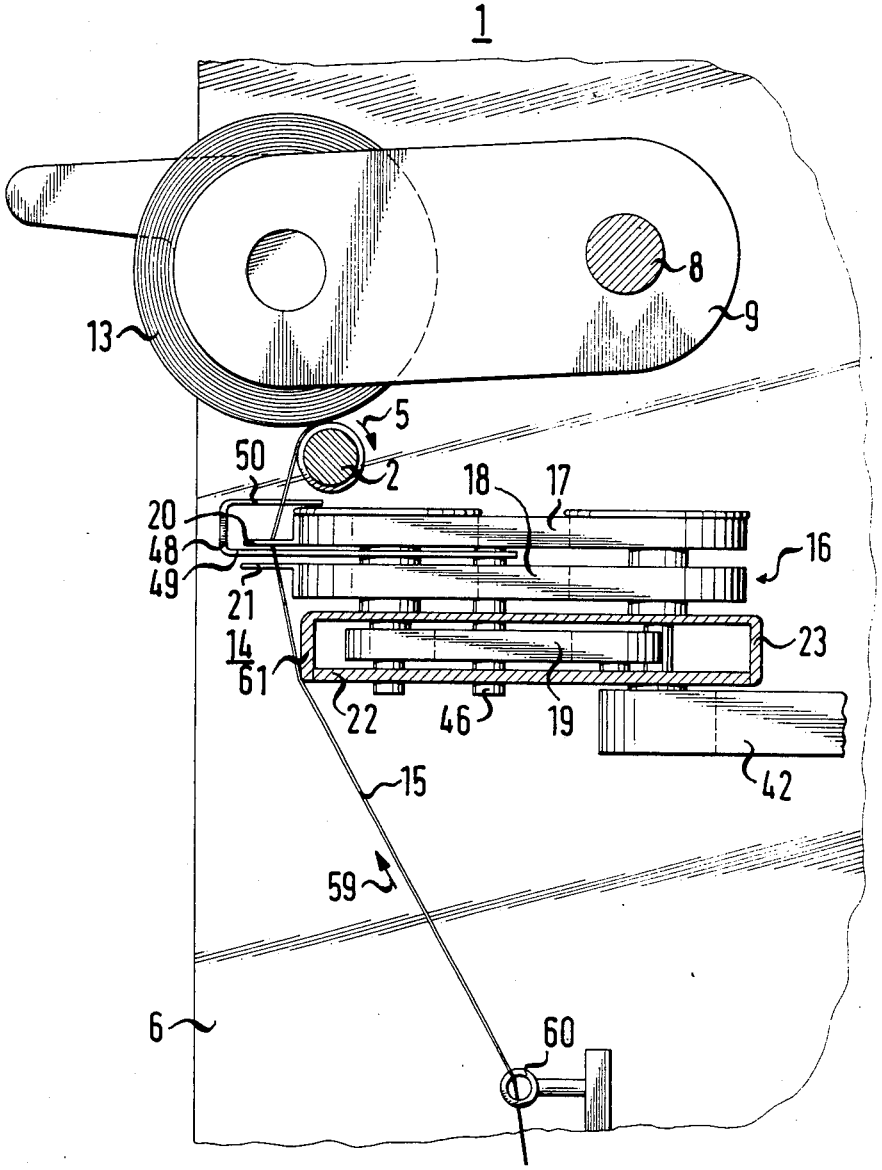
FIG. 2 is a partially cross-sectional view taken along the line II—II in FIG. 1, in the direction of the arrows.

Referring now to the figures of the drawings in detail and first, particularly, to FIGS. 1 and 2 thereof, there is seen a diagrammatic illustration of a machine 1 for producing crosswound bobbins or cheeses which shows the parts essential for an understanding of the invention, including a winding roller 2 disposed on a winding shaft 3. The winding shaft 3 is driven by a motor M and rotates in the direction of an arrow 5. The winding shaft 3 is supported in separating walls 6, 7.

A shaft 8 of a winding frame 9, which carries rotatable cones 10, 11 for receiving tube sleeves, is also mounted in the separating walls. The two tube sleeve receiving cones 10 and 11 carry a tube sleeve 12 of a cross-wound bobbin or cheese 13. The bobbin 13 lies on top of the winding roller 2 and is driven through friction by the winding roller 2.

A thread traversing device 14 for a thread 15 which is to be wound on the bobbin 13, is disposed below the winding roller 2.

The thread traversing device 14 has a belt or chain drive 16 with belts 17, 18 and 19. The belts are in the form of toothed or timing belts. The outsides of the belts 17 and 18 are provided with thread followers or carriers 20, 21, respectively, for taking along the thread: these followers are spaced at a maximum of double the distance of the traversing width.

While the belts 17 and 18 directly serve for traversing the thread, the belt 19 effect a reversal of the direction of the belt 17 to a direction opposite to the direction of the belt 18.

Figure 6:
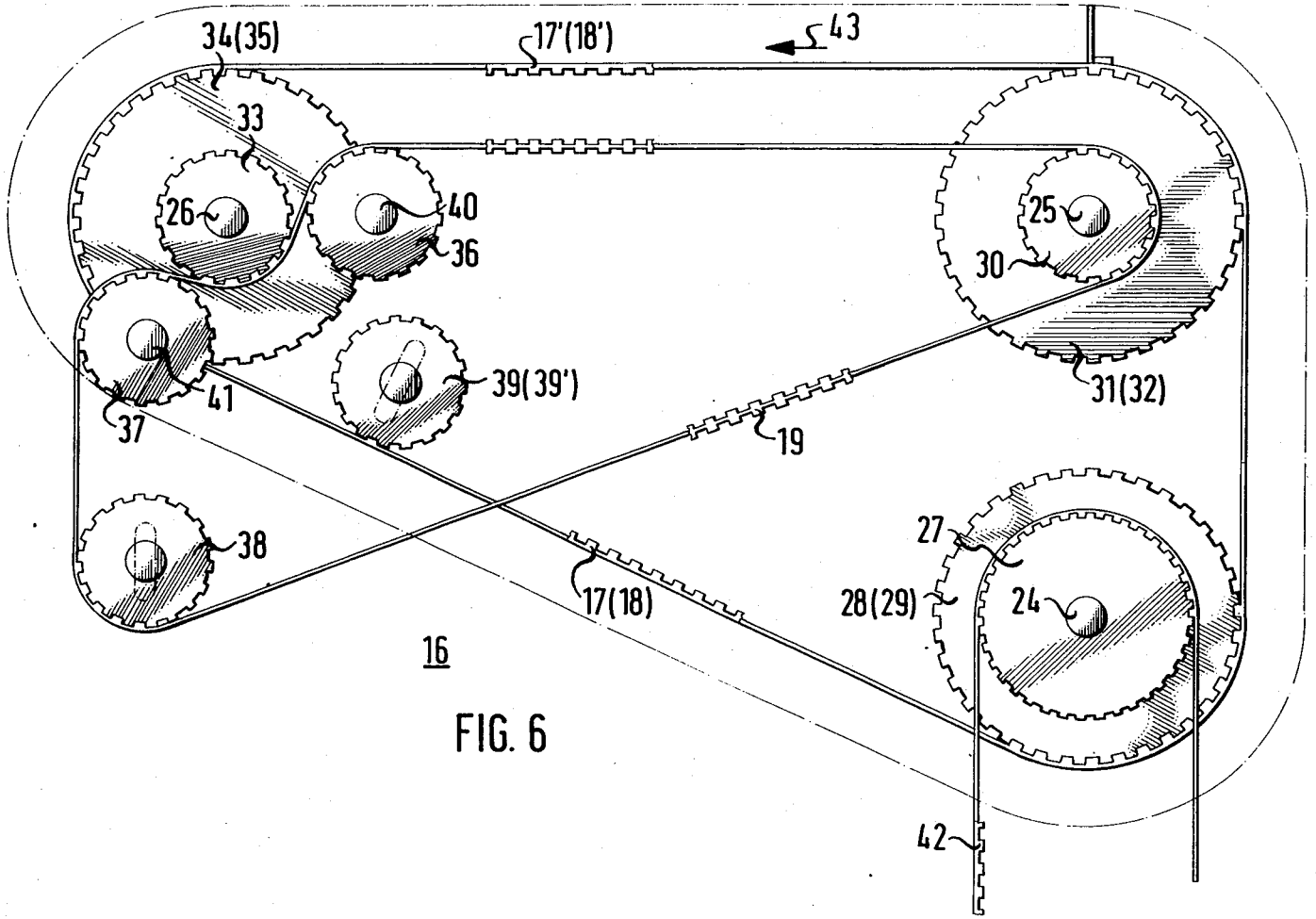
Fig. 6 is a diagrammatic illustration of the drive scheme of a belt or chain drive.
Figure 7:
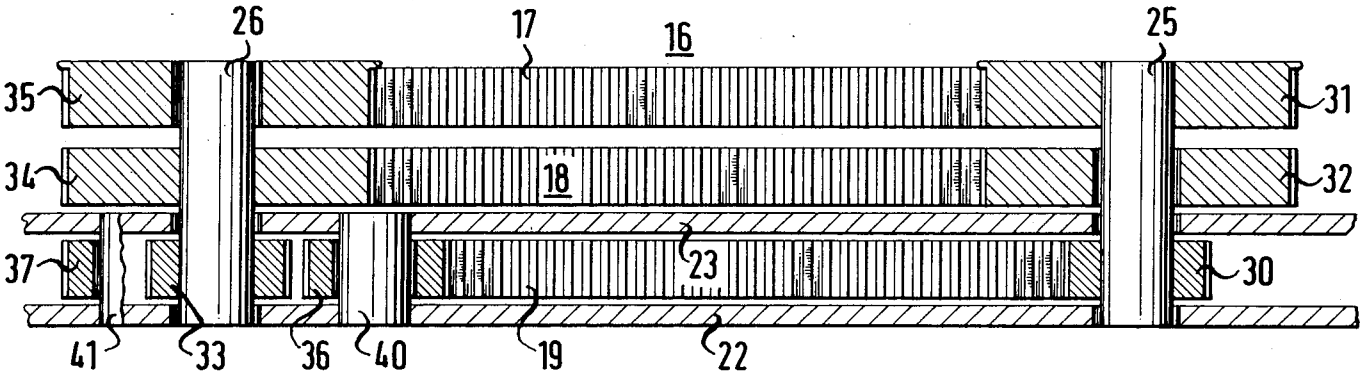
FIG. 7 is a fragmentary, cross-sectional view showing details of the belt or chain drive shown diagramatically in FIG. 6.
Figure 8:
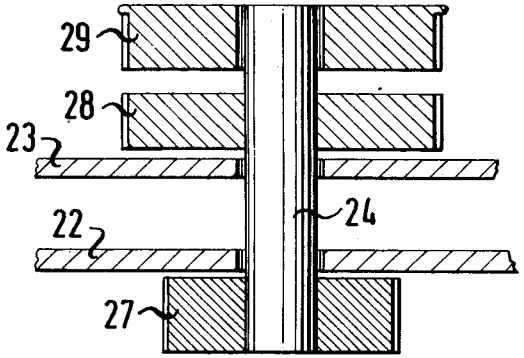
FIG. 8 is a view similar to FIG. 7 showing further details of the belt or chain drive shown diagrammatically in FIG. 6.

Three shafts 24, 25, 26 shown in FIGS. 6–8 are rotatably suported in a double-walled housing 22, 23 of the thread traversing device, which also serves as a housing for the belt or chain drive 16 Two toothed belt pulleys 27 and 28 are fixedly connected with the shaft 24. An additional toothed belt pulley 29 is rotatably supported on the shaft 24. Two toothed belt pulleys 30 and 31 are fixedly connected with the shaft 25. A toothed belt pulley 32 is rotatably supported on the shaft 25. Two toothed belt pulleys 33 and 34 are fixedly connected with the shaft 26. An additional toothed belt pulley 35 is rotatably supported on the shaft 26.

The belt 19 has teeth on both sides. The other two belts 17, 18 only have teeth on their inner surfaces.

According to FIG. 6, the belt 19 wraps around the toothed belt pulley 30, a toothed pressure disc 36, the toothed belt pulley 33, an additional toothed pressure disc 37 and a toothed tension roller 38.

According to FIG. 7, the toothed pressure disc 36 is rotatably supported on a spindle 40, and the toothed pressure disc 37 is rotatably supported on a spindle 41. The belt 19 is driven by the toothed belt pulley 33.

According to FIG. 6, the belt or chain drive is driven by a toothed belt 42, which is conducted to a non-illustrated power source. The belt 18 is driven by the toothed belt pulley 27, the shaft 24 and the pulley 28. The upper run 18' of the belt 18 moves in the direction of the arrow 43.

The belt 18 wraps around the freely running pulley 32 and the pulley 34 which is fixed to the shaft 26. The belt tension can be adjusted with the aid of the tension roller 39.

The shaft 26 drives the toothed belt pulley 33 and therefore drives the belt 19, which in turn drives the toothed belt pulley 30, which in turn drives the shaft 25. The belt 17 wraps around the pulley 31 which is fixed to the shaft 25 and also wraps around the freely rotating pulleys 35 and 29.

The belt 19 effects a reversal of the rotational direction of the toothed belt pulley 31 relative to the pulley 32, so that the upper part 17' of the belt 17 moves against the direction of the arrow 43, which is in the direction of the arrow 44, shown in FIG. 1.

The belts 17 and 18 move with the same velocity, but in opposite directions. This is assured by providing a number of teeth on the toothed belt pulleys 28, 29, 31, 32, 34, 35, which is equal to the number of teeth on the toothed belt pulleys 30 and 33.

Figure 3:
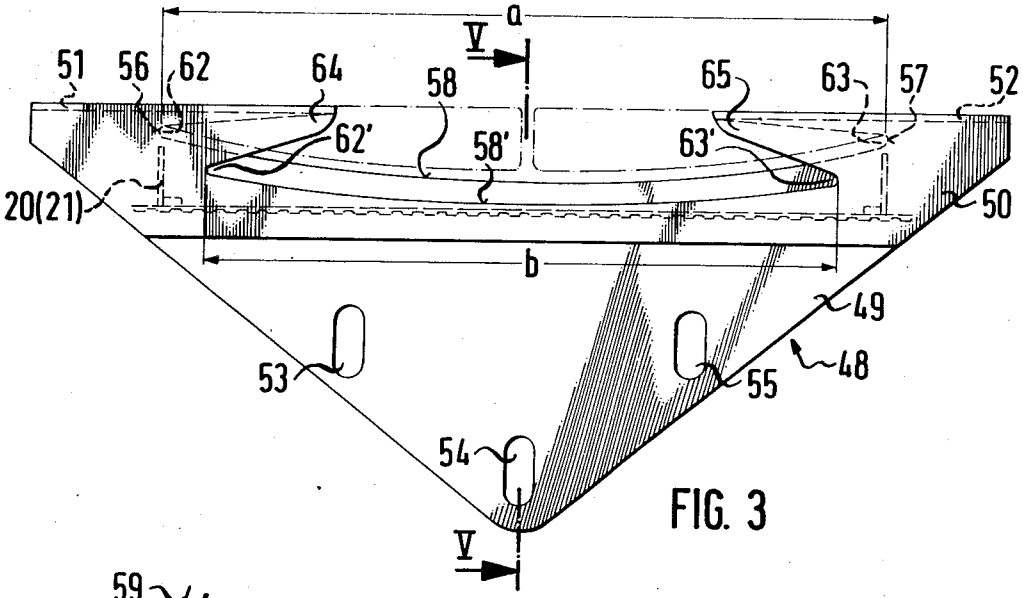
FIG. 3 is an elevational view of a one-part thread guide combination.

The length of the belts 17 and 18 depends on the traversing width "a" shown in FIG. 3. In this case the length of the belts 17 and 18 is three times the amount of the traversing width.

Figure 5:
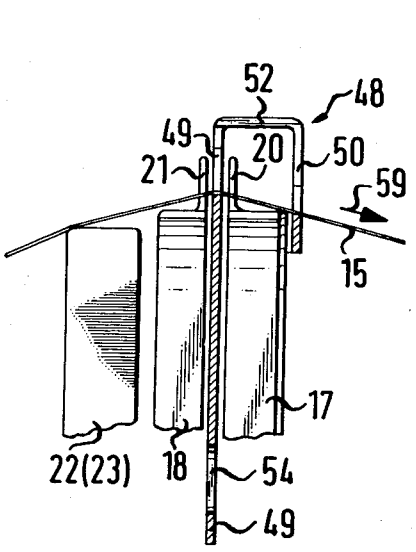
FIG. 5 is a cross-sectional view of the thread guide combination taken along the line V—V in FIG. 3, in the direction of the arrows.
Figure 4:
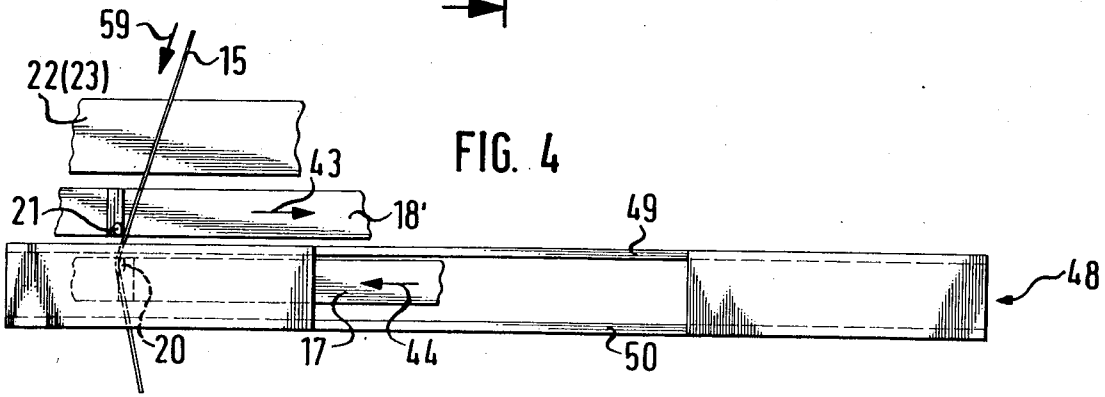
FIG. 4 is a fragmentary, top-plan view of the thread guide combination shown in FIG. 3.

According to FIG. 1, a thread guiding device 48, which is shown in FIGS. 3–5, is fastened to the housing 22, 23 with the aid of three fastening screws 45, 46, 47.

Although the thread guiding device is formed in one piece and it is produced by bending a shaped metal sheet, it actually comprises two thread guiding means, a thread guide 49 and a thread guide 50. The two thread guides 49 and 50 are connected with each other by two bridges 51 and 52. For the purpose of fastening the thread guide 49, it is provided with three elongated holes 53, 54 and 55.

The thread guide 49 has an arcuate shape and a concave thread guiding contour 58, which is contacted by the thread and reaches from one reversing point 56 of the traversing motion to another reversing point 57. In the actual illustrated embodiment, the thread guiding contour is arcuate with a radius of 380 mm.

At the traversing points 56 and 57 of the traversing path which has the traversing width "a", the thread guiding contour 58 lifts the running thread 15 over the upper end of the thread follower 20, 21, respectively.

For example, according to FIG. 4, if the thread follower 20 which travels in the direction of the arrow 44 has just released the thread 15, the thread jumps slightly in the direction of the arrow 43 ahead of the thread follower 21 due to the existing thread tension, and is then taken along by the thread follower 21 and carried along the thread guiding contour to the other reversing point 57, where the transfer operation to one of the thread followers 20 is repeated.

According to FIG. 2, the thread is conducted through a thread guide eyelet 60 and the cover 61 of the housing 22, 23. According to FIG. 1, the thread is again taken up by the thread follower 21 so that it again traverses in the direction of the arrow 43.

The thread guide 49 has stops for the thread at the reversing points 56 and 57 in the form of wedge-shaped corners 62, 63, respectively. In particular, the thread guide 49 has a projection 64, 65, respectively, at each reversing point of the traversing motion, which is directed against the traversing region, i.e. backward, and which forms the respective wedges 62, 63 with the thread guiding contour 58, which serve as stops for the thread.

The drawings show that the thread guide 49 is disposed between runs 17' and 18' of the belts which run in opposite directions. Furthermore, FIGS. 3–5 show that the thread guide 49 is constructed in the form of a plate which separates the runs 17' and 18' that move in opposite directions. Thus, if the belts should vibrate, they cannot touch each other because of the plate between them.

The other thread guide 50 is disposed at the other side of the run 17'. The second thread guide 50 is constructed the same way as the previously described thread guide 49, but has the following differences and modifications:

The distance "b" between the wedges 62', 63' of the second thread guide 50 is smaller than the distance between the wedges 62, 63 of the first thread guide 49. Furthermore, the distance from the wedges 62', 63' of the thread guide 50 to the run 17' is smaller than the distance from the wedges 62, 63 of the first thread guide 49 to the belt 17'. The thread guiding contour 58 of the first thread guide 49 is more concave than the thread guiding contour 58' of the second thread guide 50. The thread guiding contour 58' of the second thread guide 50 has an arcuate shape with a radius of 500 mm, while the other thread contour 58 has a radius of 380 mm.

It is indicated by broken lines in FIG. 3 that the bridges 51 and 52 can approach each other and the thread guiding contours 58 and 58' at a distance which is less than the width of a finger, for accident protection. This configuration of the thread guiding device is an alternative. In this case, the thread traverses within the arcuate slots and there is also a through-slot provided in the middle of the traversing region "a" for insertion and removal of the thread.

Figure 9:
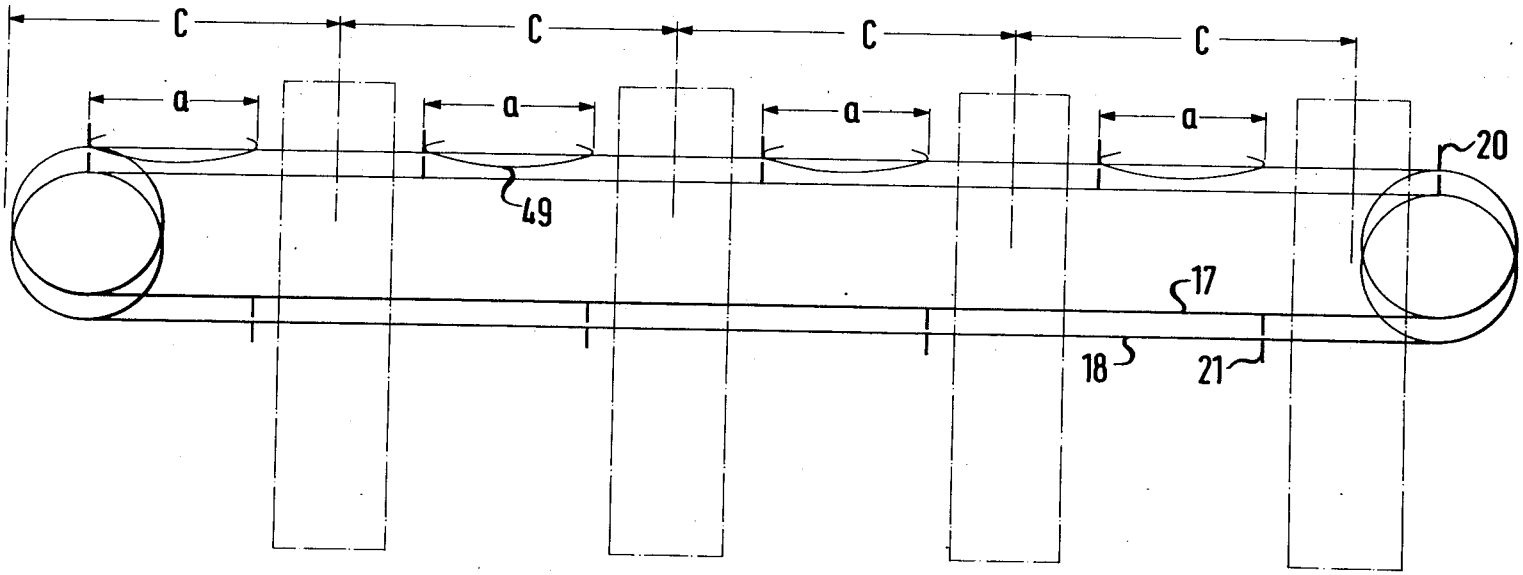
FIG. 9 is a diagrammatic illustration of a scheme of belts serving several winding stations.

As an alternative, it is clearly indicated in FIG. 9 that the belts 17, 18 which carry the thread followers 20, 21, respectively, can be conducted along more than one winding station. For example, in FIG. 9 they are conducted along four winding stations, if the condition is fulfilled that the distance "c" from the center of one winding station to the center of the next is equal to double the traversing width "a".

While the four winding stations have two common belts which are provided with thread followers, each winding station has its own thread guide 49 diagrammatically illustrated in FIG. 9.

Figure 10:
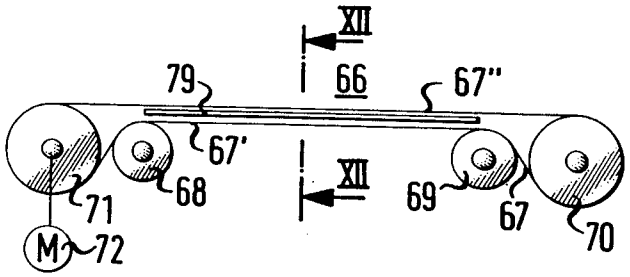
FIG. 10 is a diagrammatic illustration of a scheme of another embodiment of the invention.
Figure 13:
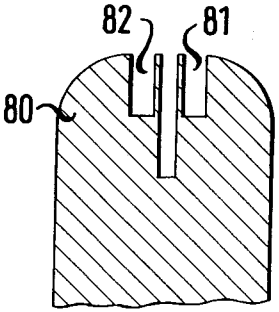
FIG. 13 is a view of part of the device shown in FIG. 12.

In the alternate construction of a thread traversing device 66 according to FIGS. 10 and 13, only a single belt 67 is provided, which runs over deflection rollers 68, 69, 70 and a drive roller 71. The drive roller 71 can be driven by a power source 72. The belt 67 is conducted at the upper edge from which thread followers 75, 76 project upward.

The run 67' of the belt which travels in the direction of an arrow 73 toward the drive roller 71, runs very close to a plate-shaped thread guide 79. The other run 67'' of the belts travels in the opposite direction, which is the direction of an arrow 74 and is also very close to the other side of the thread guide 79.

Figure 12:
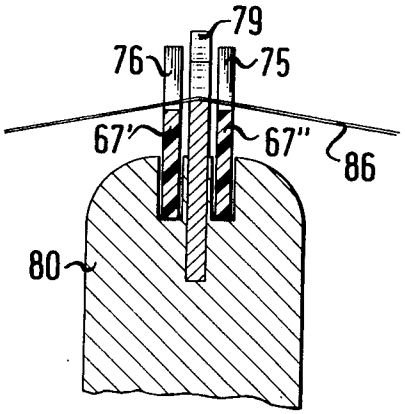
FIG. 12 is a cross-sectional view taken along the line XII—XII in FIG. 10, in the direction of the arrows.

According to FIGS. 12 and 13, the thread guide 79 is secured by a holding bar 80, which is also provided with guide slots 81 and 82 for the belt 67.

Figure 11:
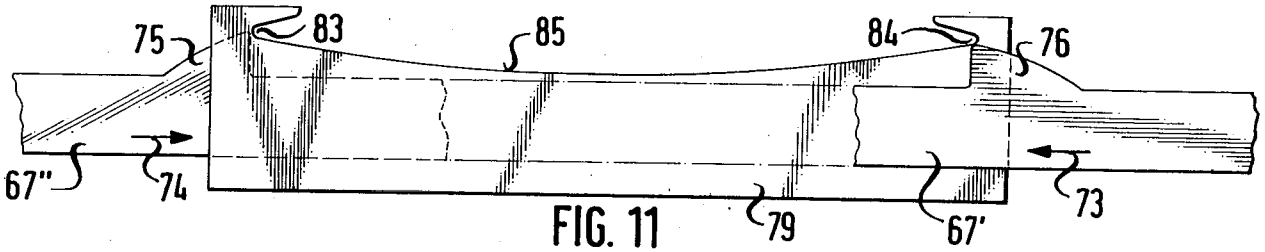
FIG. 11 is a fragmentary, elevational view of the configuration of the belts and the thread guide of the device shown in FIG. 10.

The thread guide 79 also has an arcuate-shaped and concave thread-guiding contour 85, which reaches from one reversing point 83 to the other reversing point 84 of the traversing motion, and which is contacted by the running thread. Even at its lowest point, the thread guiding contour 85 still lies above the belt 67, so that a thread 86 touches the thread guiding contour 85, but does not touch the part of the belt 67 which runs in the opposite direction, as shown in FIG. 12. FIG. 11 shows that the thread guiding contour 85 at its highest point extends slightly above the thread followers 75 and 76. With respect to FIG. 11, it should be mentioned that the thread follower 75 is not shown positioned correctly with respect to the thread follower 76. In the operating position, the followers run past each other at the reversing points 83 and 84 of the traversing path.

The invention is not limited to the illustrated and described embodiments which were used as examples.

We claim:

1. Thread traversing device of a cross-wound bobbin producing machine, comprising a belt drive having a first belt run with a first thread follower moving in a given traversing direction at a given speed and a second belt run with a second thread follower moving in a direction opposite to said given traversing direction at said given speed, said thread followers having upper ends and being spaced apart by at most twice a given traversing width, and a stationary thread guide for transferring a running thread from one of said thread followers to the other, said thread guide having a concave thread guiding contour touched by the running thread with reversing points defining a traversing path therebetween, said thread guide including a projection disposed at each respective reversing point pointing toward the other reversing point and forming a wedge with said thread guiding contour defining thread stops, and said thread guiding contour lifting the running thread at said reversing points over the upper end of one of said thread followers so that the thread is taken along by the other of said thread followers and rides on said thread guiding contour.

2. Thread traversing device according to claim 1, wherein said thread guide is disposed between said belt runs travelling in opposite directions.

3. Thread traversing device according to claim 1, wherein said thread guide is in the form of a plate separating said oppositely travelling belt runs from each other.

4. Thread traversing device according to claim 1, wherein said thread guide is disposed on one side of one of said belt runs, and including at least one other thread guide having a concave thread guiding contour disposed on the opposite side of said one belt run.

5. Thread traversing device according to claim 4, wherein said other thread guide includes a projection disposed at each respective reversing point pointing toward the other reversing point and forming a wedge with said thread guiding contour defining stops, said wedges of said first-mentioned thread guide being farther apart from each other than said wedges of said other thread guide.

6. Thread traversing device according to claim 5, wherein said wedges of said other thread guide are closer to said one belt run than said wedges of said first-mentioned thread guide.

7. Thread traversing device according to claim 4, wherein said thread guiding contour of said first-mentioned thread guide is more concave than said thread guiding contour of said other thread guide.

8. Thread traversing device according to claim 4, including bridges disposed outside said traversing path interconnecting said first-mentioned and other thread guide.

9. Thread traversing device according to claim 8, wherein said first-mentioned and other thread guides and said bridges are made of bent and formed sheet metal.

10. Thread traversing device according to claim 8, wherein said bridges are disposed less than the width of a finger of an operator of the machine from each other and from said thread guiding contours for accident protection.

11. Thread traversing device according to claim 1, wherein the bobbin producing machine includes a plurality of winding stations with centers mutually spaced apart by a distance equal to twice said given traversing width, and said belts carrying said followers are disposed along more than one of the winding stations.

* * * * *